United States Patent [19]

Schisler et al.

[11] Patent Number: 4,986,474

[45] Date of Patent: Jan. 22, 1991

[54] STREAM PROPELLED ROTARY POP-UP SPRINKLER

[75] Inventors: Richard L. Schisler; George L. Sesser, both of Walla Walla, Wash.

[73] Assignee: Nelson Irrigation Corporation, Walla Walla, Wash.

[21] Appl. No.: 390,286

[22] Filed: Aug. 7, 1989

[51] Int. Cl.[5] ..... B05B 3/04

[52] U.S. Cl. ..... 239/205; 239/206; 239/252; 239/222.17; 239/396

[58] Field of Search ..... 239/203–206, 239/252, 396, 222.17; 188/290, 322.5

[56] References Cited

U.S. PATENT DOCUMENTS

| | | | |
|---|---|---|---|
| Re. 32,386 | 3/1987 | Hunter . | |
| 275,124 | 0/1883 | Blumenberg . | |
| D. 299,156 | 12/1988 | Heren . | |
| 535,655 | 0/1895 | Anderson . | |
| 1,510,930 | 10/1924 | Enell . | |
| 1,821,579 | 9/1931 | Rader . | |
| 1,919,244 | 7/1933 | Munz . | |
| 2,128,552 | 8/1938 | Rader et al. . | |
| 2,493,595 | 1/1950 | Rieger . | |
| 2,796,293 | 6/1957 | Becker . | |
| 2,990,120 | 6/1961 | Reynolds . | |
| 3,006,558 | 10/1961 | Jacobs . | |
| 3,415,258 | 12/1968 | Gilson . | |
| 3,454,225 | 7/1969 | Hunter . | |
| 3,580,514 | 5/1971 | Radecki . | |
| 3,713,584 | 1/1973 | Hunter . | |
| 3,724,757 | 4/1973 | Hunter . | |
| 3,848,675 | 11/1974 | Evans . | |
| 3,854,664 | 12/1974 | Hunter . | |
| 3,921,910 | 11/1975 | Hayes et al. . | |
| 3,934,820 | 1/1976 | Phaup . | |
| 3,955,764 | 5/1976 | Phaup . | |
| 3,977,063 | 8/1976 | Bruninga . | |
| 4,131,234 | 12/1978 | Pescetto . | |
| 4,181,259 | 1/1980 | Ridgway . | |
| 4,189,099 | 2/1980 | Bruninga . | |
| 4,201,344 | 5/1980 | Lichte . | |
| 4,322,860 | 4/1982 | Gould . | |
| 4,331,294 | 5/1982 | Gilad . | |
| 4,353,506 | 10/1982 | Hayes . | |
| 4,356,972 | 11/1982 | Vikre . | |
| 4,432,495 | 2/1984 | Bruninga . | |
| 4,471,908 | 9/1984 | Hunter | 239/206 X |
| 4,560,108 | 12/1985 | Rubinstein | 239/206 X |
| 4,624,412 | 11/1986 | Hunter | 239/206 X |
| 4,634,052 | 1/1987 | Grizzle et al. | 239/206 X |
| 4,650,118 | 3/1987 | Saarem et al. | 239/206 X |
| 4,660,766 | 4/1987 | Nelson et al. | 239/222.17 |
| 4,687,139 | 8/1987 | Lockwood | 239/222.17 |
| 4,718,605 | 1/1988 | Hunter | 239/222.17 |
| 4,749,127 | 6/1988 | Ash | 239/222.17 |
| 4,754,925 | 7/1988 | Rubinstein | 239/222.17 |
| 4,781,327 | 11/1988 | Lawson et al. | 239/205 X |
| 4,796,809 | 1/1989 | Hunter | 239/222.17 |
| 4,796,811 | 1/1989 | Davisson | 239/222.17 |
| 4,815,662 | 3/1989 | Hunter | 239/206 X |
| 4,842,201 | 6/1989 | Hunter | 239/396 |
| 4,932,590 | 6/1990 | Hunter | 239/206 X |

FOREIGN PATENT DOCUMENTS

| | | |
|---|---|---|
| 1256534 | 4/1971 | United Kingdom . |

*Primary Examiner*—Andres Kashnikow
*Assistant Examiner*—William Grant
*Attorney, Agent, or Firm*—Nixon & Vanderhye

[57] ABSTRACT

The present invention relates to a rotary pop-up type sprinkler device which includes a stationary nozzle for issuing a stream of water which engages a rotary distributor. The device includes a first outer housing designed for in-ground installation, and a second inner housing telescopically mounted within the outer housing. Upon commencement of flow of water under pressure into the sprinkler device, the second inner housing is extended to an above ground or operative position. The second inner housing is normally spring biased to the below ground inoperative position so that, upon cessation of the supply of water under pressure, the second inner housing returns automatically to its below ground inoperative position within the first outer housing. The second inner housing is also provided with a nozzle disk including at least one discharge orifice for discharging the stream of water under pressure. The second inner housing also mounts a speed reducing assembly for slowing the rotational speed of the distributor. The speed reducing assembly includes a shaft which supports the rotary distributor at one end thereof downstream of the discharge orifice. The other end of the shaft is received within a speed reducing assembly housing located upstream of the discharge orifice. A flow path is established which isolates both the shaft and substantially all of the brake assembly housing from contact with water under pressure upstream of the discharge orifice.

29 Claims, 4 Drawing Sheets

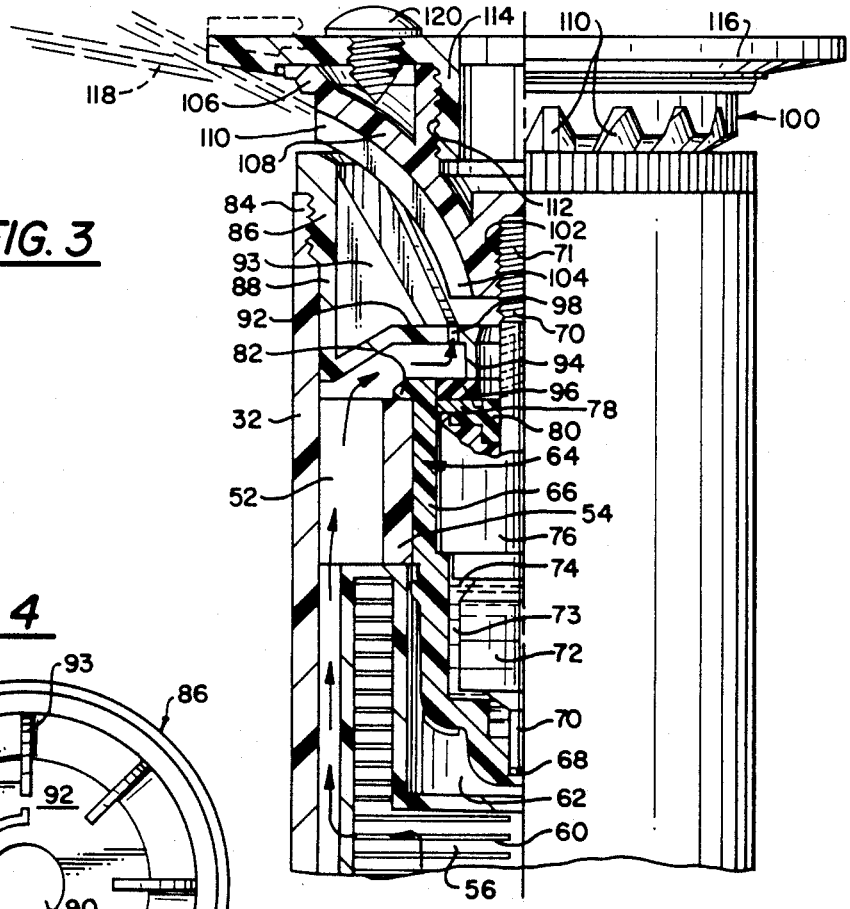
FIG. 3
FIG. 4
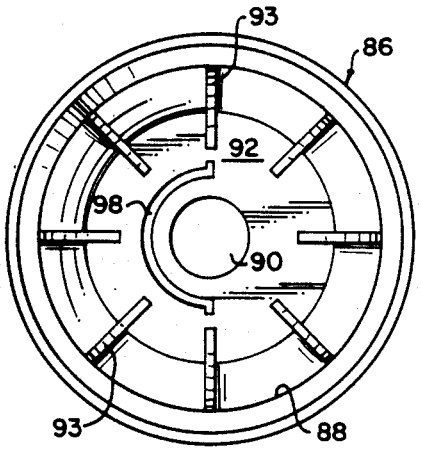
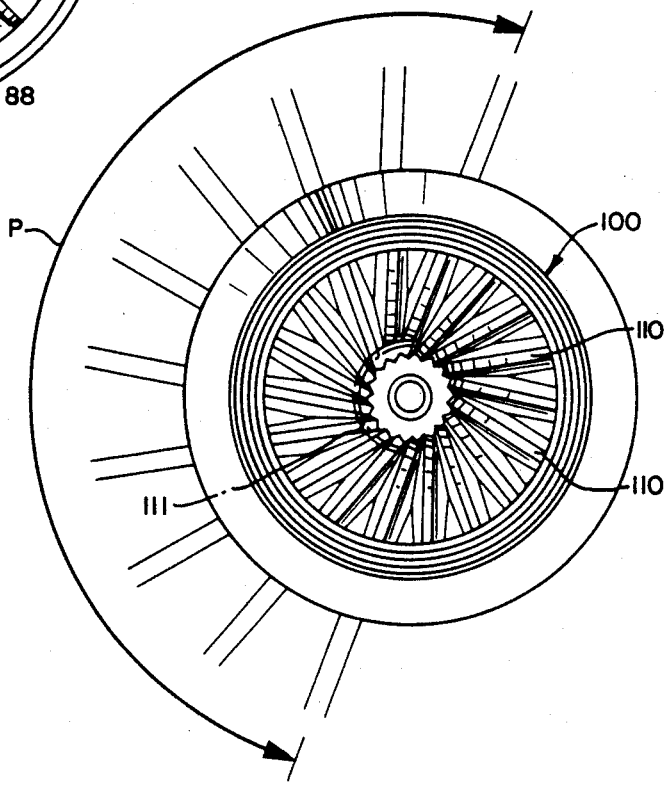
FIG. 5

FIG. 6
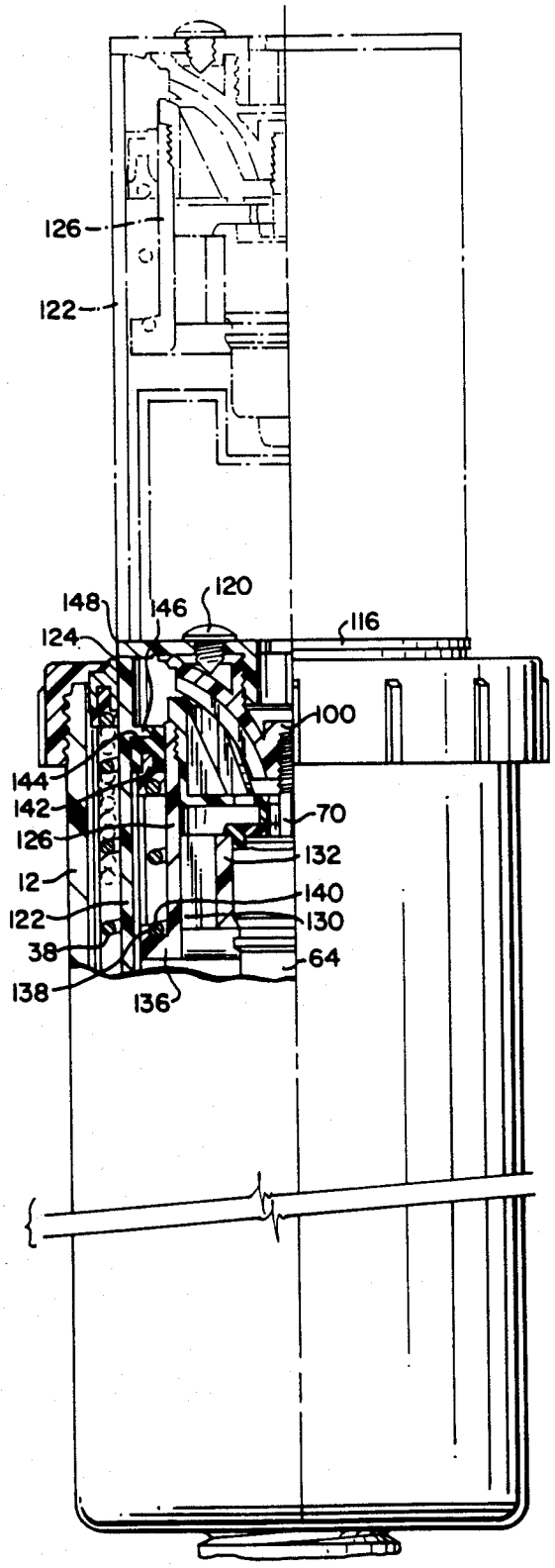
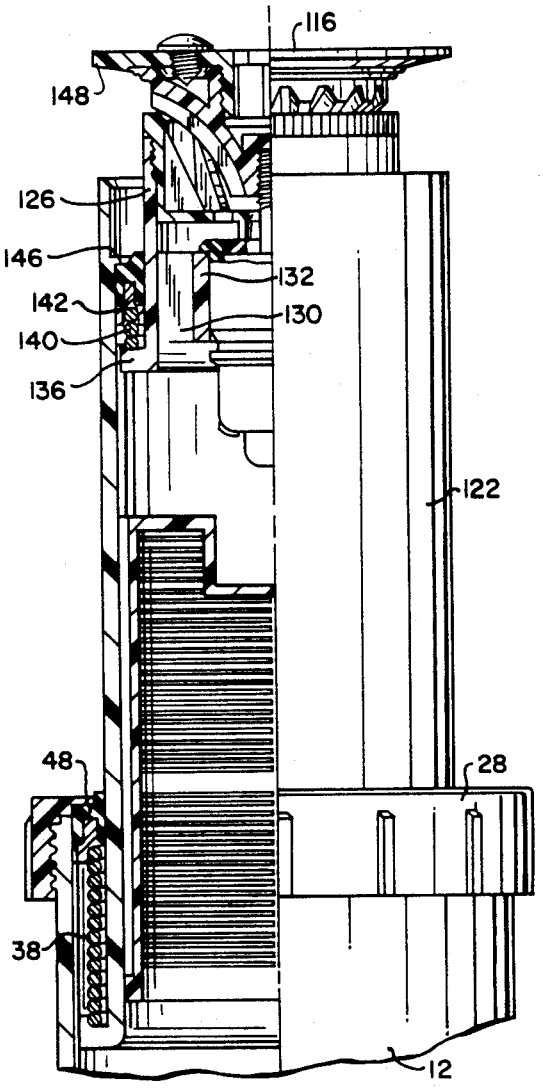
FIG. 7
FIG. 8
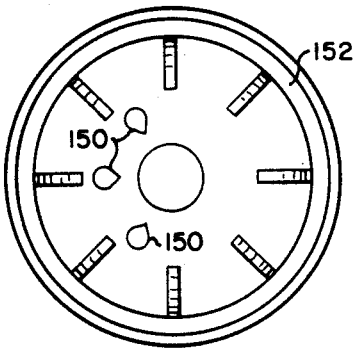

STREAM PROPELLED ROTARY POP-UP SPRINKLER

BACKGROUND AND SUMMARY OF THE INVENTION

This invention relates generally to sprinkler devices and, more specifically, to rotary sprinkler devices of the pop-up type. These are devices which are designed for in-ground installation typically used in automatic sprinkler systems, and where the sprinkler head moves from a below ground inoperative position, to an above ground operative position in response to the flow of water under pressure.

Rotary sprinklers of the pop-up type are well represented in the patent literature. See for example, U.S. Pat. Nos. Re. 32,386; 3,713,584; 3,724,757; and 3,921,910. In addition, U.S. Pat. No. 3,934,820 describes a rotary pop-up sprinkler which utilizes a gear train to reduce the rotational speed of the rotary nozzle. Reversible, turbine driven sprinkler heads are described in U.S. Pat. Nos. 4,201,344 and 4,624,412. A two-stage pop-up rotary sprinkler is disclosed in U.S. Pat. No. 4,796,809, while the utilization of a viscous brake for controlling nozzle rotation in a pop-up sprinkler is described in U.S. Pat. No. 4,815,662.

Commonly owned prior U.S. Pat. Nos. 4,660,766 and 4,796,811 disclose rotary sprinklers of a non pop-up type which incorporate viscous speed reducing assemblies for slowing the rotational speed of a rotary distributor driven by a water stream discharged from an otherwise stationary nozzle.

The present invention relates to a stream propelled rotary sprinkler of the pop-up type which is characterized by improved performance, simplified construction and lower cost than prior sprinklers of the same or similar type, as explained in greater detail below.

SUMMARY OF THE INVENTION

The present invention relates to a rotary pop-up type sprinkler device which includes a stationary nozzle for issuing a stream of water which impinges on a rotary distributor which, in turn, distributes the water over a predetermined area. The device includes a first outer housing designed for in-ground installation, and a second inner housing telescopically mounted within the first outer housing. Upon commencement of flow of water under pressure into the sprinkler device, the second inner housing is extended to an above ground or operative position. In this regard, the second inner housing is spring biased to the below ground inoperative position so that, upon cessation of the supply of water under pressure, the second inner housing returns automatically to its below ground inoperative position within the first outer housing.

The second inner housing is also provided with a nozzle disk formed with at least one discharge orifice for discharging the stream of water under pressure. The discharge orifice may take a variety of arcuate or other shapes to provide the desired sprinkling pattern as described in greater detail below.

The second inner housing also mounts a "rotor motor" or viscous speed reducing assembly for slowing the rotational speed of the distributor which would otherwise rotate at high speed (e.g., about 1800 rpm or more) as a result of the direct impingement of the pressurized stream on slightly radially offset grooves formed in the distributor. The speed reducing or brake assembly includes a shaft which supports the rotary distributor at one end thereof in axially spaced relationship to the discharge orifice. The other end of the shaft is received within a brake assembly housing.

The viscous brake assembly is preferably of the type disclosed in commonly owned U.S. Pat. Nos. 4,660,766 and 4,796,811, and operates on a viscous shear principle whereby viscous liquid between a drum member fixed for rotation with the shaft is caused to shear as the drum rotates in close relationship to the surrounding wall of a chamber in the brake assembly housing. The brake assembly is effective to reduce the rotational speed of the distributor from an unbraked speed of about 1800 rpm or more for a given pressure, to a desired speed of from about ¼ to 12 rpm at the same pressure. Such speed reduction maximizes the "throw" of the water, while minimizing the well known and undesirable "horse tail" effect.

The viscous brake assembly is located relative to the flow path of the water within the inner housing such that substantially all of the brake assembly housing, as well as the brake assembly shaft are isolated from water under pressure upstream of the nozzle disk and associated discharge orifice(s). As a result, no dynamic shaft seal or seals are needed to prevent pressurized water from entering the brake assembly housing. Any water that does contact the shaft externally of the housing has already been discharged from the nozzle disk into atmospheric space, and is at minimal or at least substantially reduced pressure.

The rotary distributor in accordance with an exemplary embodiment of the invention is provided with a plurality of radially outwardly and upwardly extending grooves that are slightly radially offset, so that when the stream of water impinges on the grooves, rotary motion is imparted to the distributor.

It is another feature of this invention that the pressurized water flows through a filtration screen as it travels through the inner housing of the sprinkler device to the discharge orifice(s), and that the screen be configured to include a solid recessed portion which encloses a substantial portion of the brake assembly housing.

It is another feature of the invention that the discharge orifice be in the form of an arcuate slot formed in a replaceable disk, so that a number of nozzle components may be provided, with slots varying in 15° increments from about 90° to about 270°, as well as one with a full 360° slot, to thereby provide great flexibility in determining the extent of the sprinkling pattern, as well as ease of servicing or replacement. Other orifice shapes may also be employed.

It is still another feature of the invention to provide an adjustable deflector plate on the upper surface of the rotary distributor so that the stream issuing from the distributor, if desired, may be deflected slightly downwardly to shorten the radial extent of the sprinkling pattern.

In an alternative embodiment of the invention, a pair of inner housings may be provided, one telescopically mounted within the other so that the pop-up action is carried out in two successive stages as described in greater detail herein.

It will be appreciated that the viscous brake assembly and flow path arrangement of the present invention have many advantages over sprinkler constructions in the prior art. For example, the diversion of water away from the shaft eliminates the need for dynamic shaft seals otherwise required to prevent pressurized water from entering the viscous brake assembly housing. At the same time, the viscous brake assembly is capable of reducing rotational speed of the distributor from an unbraked speed of about 1800 rpm or more to a braked speed of about ¼–12 rpm to maximize the throw of the water issuing from the sprinkler device.

It will be understood by those skilled in the art that, while the disclosed viscous brake is preferred for use with this invention, other braking means may be employed which are capable of effecting speed reductions on the order indicated above.

Thus, in one aspect, the present invention relates to a pop-up, rotating stream sprinkler device comprising:

a first outer housing having a first longitudinal axis, and an inlet end adapted for connection to a source of liquid under pressure;

a second inner housing telescopically mounted within the first outer housing for movement between retracted and extended positions, and having a second longitudinal axis coincident with the first longitudinal axis, and an outlet end adapted to discharge to atmosphere a stream of liquid under pressure;

a brake assembly including a brake assembly housing mounted in the second inner housing;

a shaft adjacent the outlet end of the second tubular member, one end of the shaft supporting a rotary distributor downstream of the outlet, and the other end of the shaft rotatably mounted in the brake assembly housing upstream of the outlet; and wherein the shaft is isolated from the liquid under pressure at all points upstream of the outlet end.

It will be appreciated that the sprinkler device as disclosed herein provides a simplified construction which improves performance by maximizing the throw of the water stream via a simple but effective viscous brake assembly, while reducing cost and increasing durability by eliminating the need for pressurized dynamic shaft seals and other drive components typically utilized in such sprinklers.

Other objects and advantages of the present invention will become apparent from the detailed description of the invention which follows.

BRIEF DESCRIPTION OF THE DRAWINGS

FIG. 3 is an enlarged, partial section of the sprinkler illustrated in FIG. 2;

FIG. 4 is a plan view of a nozzle disk for use in the present invention;

FIG. 5 is a bottom view of a rotary distributor for use in the present invention;

FIG. 6 is a partial side view, partly in section, illustrating a double pop-up type sprinkler in accordance with another embodiment of the invention, wherein the nozzle and distributor are shown in a retracted or inoperative position in solid lines, and in a partially extended position in phantom;

FIG. 7 is a partial side view, partly in section, illustrating a double pop-up type sprinkler as shown in FIG. 6, wherein the nozzle and distributor are in a fully extended or operative position; and FIG. 8 is a plan view of an alternative nozzle disk for use with the sprinkler device in accordance with the invention.

DETAILED DESCRIPTION OF THE DRAWINGS

Figure 1:
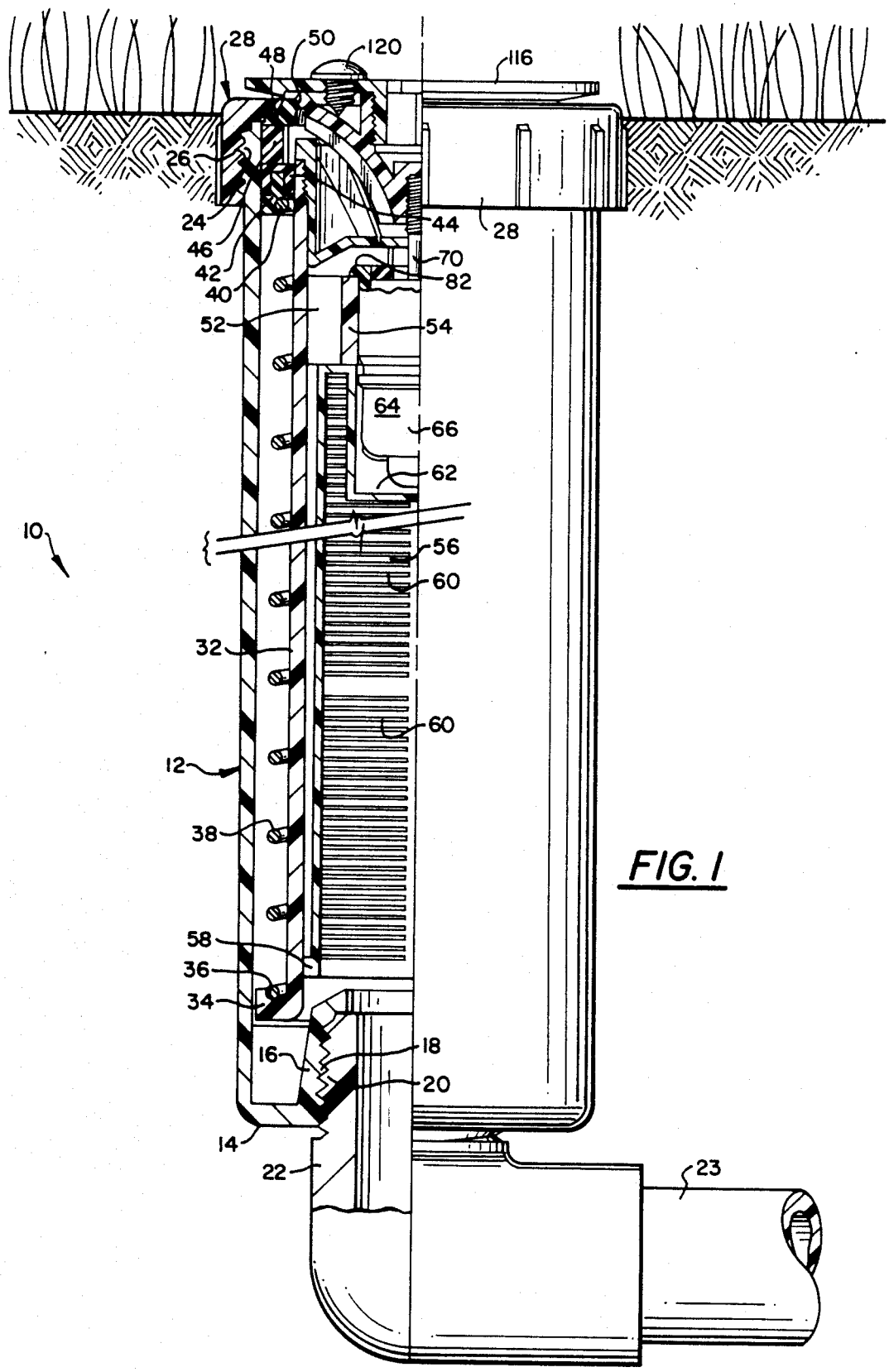
FIG. 1 is a side view, partially in section, illustrating a pop-up type sprinkler in accordance with one exemplary embodiment of the invention, in a below ground, inoperative position.
Figure 2:
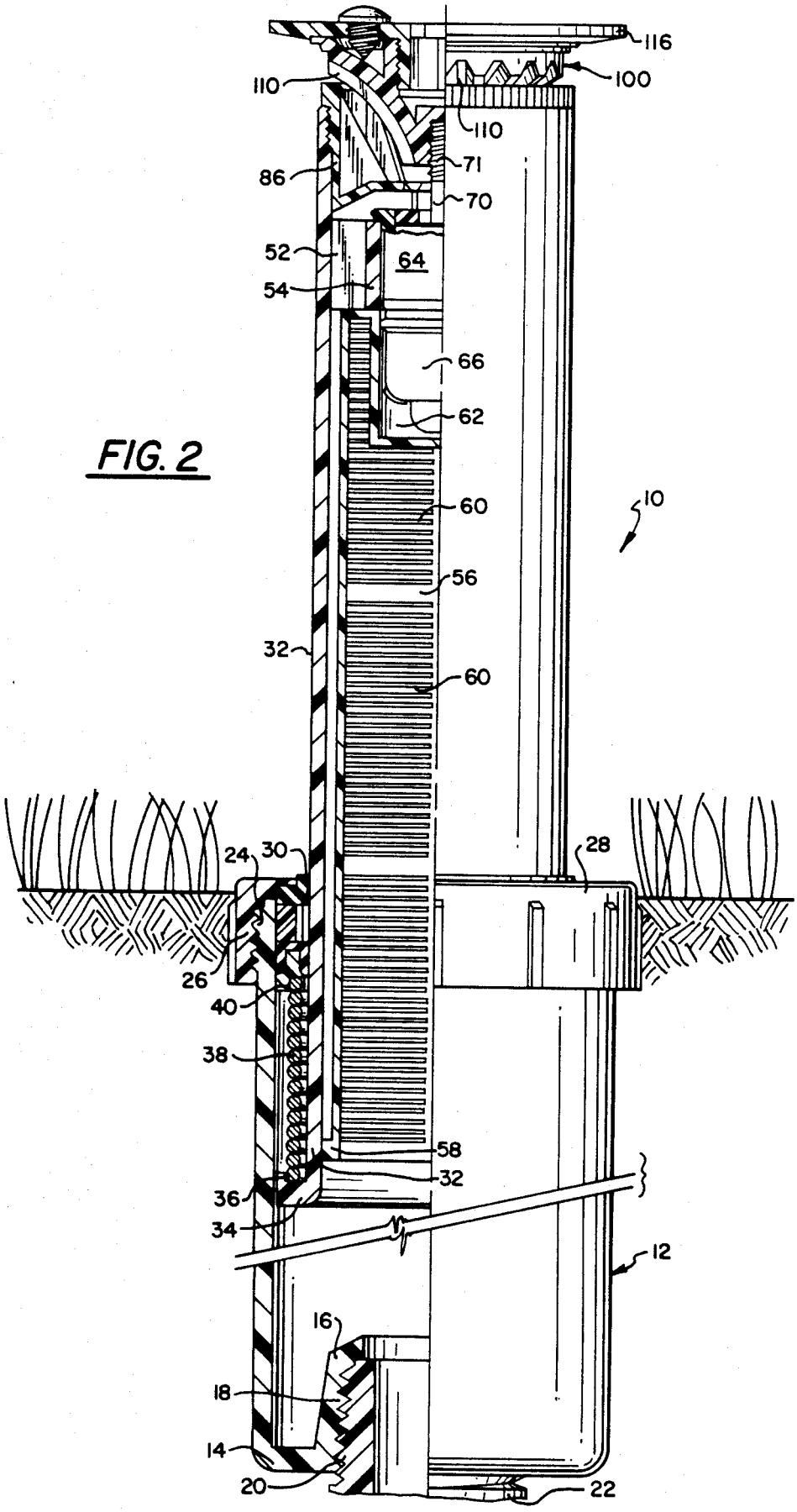
FIG. 2 is a side view, partially in section, illustrating the sprinkler of FIG. 1 but with the sprinkler nozzle and distributor in an extended, operative position.

With reference now particularly to FIGS. 1 through 3, there is illustrated a pop-up sprinkler 10 in accordance with an exemplary embodiment of the invention. The sprinkler includes an outer, substantially cylindrical housing 12 provided with a bottom wall 14. The bottom wall is formed with a centrally located, inlet port 16 having threads 18 for engaging corresponding threads 20 of a fitting 22 which may be connected, via a conduit 23, to a source of water under pressure.

The upper open end of the first outer housing 12 is formed with external threads 24 which are adapted to engage corresponding threads 26 of an end cap 28. The end cap 28 is formed with a central opening 30, as best seen in FIG. 2, for a purpose described below.

A second inner substantially cylindrical housing 32 is telescopically arranged within the first outer housing 12 for relative sliding movement into and out of the first housing, by way of opening 30 in the end cap 28. To this end, the tubular inner housing 32 is provided with a radially outwardly directed flange 34 at its lowermost end, forming an annular retaining groove 36 for receiving the lowermost turn of a metal coil spring 38. The first and second housings 12 and 32, respectively, as well as end cap 28 are preferably constructed of relatively rigid plastic.

The coil spring 38 has a diameter slightly larger than the outer diameter of the inner housing 32 and is concentrically located between the first outer housing 12 and the second inner housing 32. The uppermost turn of coil spring 38 fits within an annular retaining groove 40 of an annular spring cap 42 located proximate to the end cap 28. An inverted U-shaped annular seal 44, preferably of a rubber or polymeric material, is fitted over the cap 42. A plastic annular spacer ring 46 sits atop the seal 44 and, at the same time supports an upper annular seal 48 received within the opening 30 of the cap 28. The upper annular seal 48 has an inwardly and upwardly directed sealing edge 50 which has a dual sealing function as described in greater detail further herein.

It will be appreciated that with end cap 28 in place, the inner housing 32 is spring biased to a lowered position, i.e., in the inoperative position illustrated in FIG. 1, by reason of spring pressure exerted on the lower flange 34 of the inner tubular housing 32. In this inoperative position, sealing edge 50 of seal 48 prevents dirt and other debris from getting inside the device.

Within the hollow upper portion of the inner housing 32, there are provided a plurality of integral and radially inwardly directed ribs 52 which support an integral support ring or collar 54. Below the support ring 54, a cylindrical basket-type filter or screen 56 is arranged, extending between the ring 54 and the lower end of the inner housing 32, where a radial flange 58 engages the inner surface of the inner housing 32. The cylindrical screen 56, also preferably constructed of a plastic material, and formed with an array of parallel, closely spaced slots 60, is further provided with a centrally located, solid recessed area 62 at its upper end for a purpose described below.

Rotor motor 64 comprises a viscous brake assembly generally of the type disclosed in commonly owned U.S. Pat. No. 4,660,776. As best seen in FIG. 3, the rotor motor or brake assembly 64 comprises a generally cylindrical housing 66, preferably constructed of relatively rigid plastic material, the interior of which is formed with a lower recess 68 for receiving a shaft 70. Attached to the shaft 70 is a brake drum 72 which rotates with the shaft in a chamber portion 73 which contains a viscous fluid, e.g., oil 74. A bearing 76 is press fit within the housing 66 and remains stationary while shaft 70 is free to rotate within the bearing. The entire shaft/brake assembly is held within the housing by a retainer 78 (preferably brass) which is press fit into the open upper end of the housing 66. A resilient ring 80, interposed between the bearing 76 and brass retainer 78, engages the shaft 70 and serves to prevent ingress of non-pressurized water, i.e., water already discharged from the sprinkler, (or debris) and egress of viscous fluid from the housing along the shaft.

As best seen in FIG. 3, an upper flange 82 of the motor housing 66 rests on the upper surface of ring or collar 54, with the output shaft 70 of the motor extending upwardly, above the ring 54 but generally within the inner housing 32. In this manner, the brake assembly housing or rotor motor is supported substantially entirely within an enclosed area formed by the solid recessed area 62 and the ring or collar 54.

The upper open end of inner housing 32 is internally threaded as at 84 to receive a nozzle disk 86. The nozzle disk 86 is formed with a substantially vertical peripheral annular wall 88, part of which is threaded to cooperate with the threads on the inner housing 32, thus facilitating easy removal and/or replacement of the nozzle disk. As best shown in FIG. 4, the nozzle disk has a central opening 90 located in a generally horizontal wall 92 of the disk, so that shaft 70 will project upwardly beyond the opening 90. A series of reinforcing ribs 93 are annularly spaced about the disk, extending between the peripheral wall 88 and horizontal wall 92. A downwardly extending skirt 94 projects below the opening 90, and engages a static seal, such as a resilient washer 96 fitted atop the rotor motor 64, and in engagement with the upper surface of brass retainer 78.

Radially outwardly adjacent the sealing skirt 94, there is a discharge orifice in the form of an arcuate slot 98 which, in the exemplary embodiment, is shown to extend approximately 180° about the longitudinal axis of the sprinkler which is coincident with the center line or longitudinal axis of the shaft 70.

The upper end of shaft 70 is threaded as at 71 to receive a rotary distributor 100 provided with an internal bore 102 formed with threads adapted to engage the threads 71 of the shaft 70. Threads 71 may extend along the shaft 70 at least to the resilient ring 80, as shown in phantom in FIG. 3. In this way, the threads tend to prevent settling of debris in the recessed area adjacent the shaft at its point of entry into the housing 66.

Distributor 100, as best seen in FIGS. 3 and 5, has a generally conical configuration with a small diameter end 104 and a large diameter end 106. Bore 102 is formed in the small diameter end so that, in use, the exterior rotor surface which is contacted by the water stream extends upwardly and outwardly relative to the motor shaft 70. The generally conical surface 108 of the distributor is formed with a plurality of grooves or channels 110 extending between the small diameter end 104 and large diameter end 106.

As best seen in FIG. 5, each groove or channel 110 extends outwardly, but is slightly radially offset from the center of the distributor, so that a stream issuing from the discharge orifice 98 impinging on the grooves 110 will cause the distributor 100 and shaft 70 to rotate.

FIG. 5 also illustrates a nozzle impingement area 111 corresponding to nozzle orifice 98 to create a spray pattern P. As before mentioned, various nozzle disks with slots extending over various arcs up to and including a full circle, may be selected as desired. Preferably, disks with slots, beginning at 90°, and in 15° increments to 270° and one additional nozzle disk having a 360° slot provided. Of course, many other slot configurations may be utilized, in different increments, and with various slot shapes, to create a desired sprinkling pattern. One such example of another slot configuration is illustrated in FIG. 8, where three tear-shaped orifices 150 are formed in the nozzle disk 152.

Referring back to FIG. 3, the distributor 100 has an upper bore 112 provided with internal screw threads for receiving a threaded stub portion 114 of an adjustable deflector ring 116. It will be appreciated that by turning the ring clockwise or counterclockwise, the ring will be lowered or raised, respectively, relative to the discharged stream 118. By this arrangement, the degree of deflection, and thus the distance over which the stream is projected, may be varied as desired. A locking screw 120 is also provided to permit the deflector to be locked in its maximum deflection position as illustrated in FIG. 3.

With the rotor motor 64 and nozzle 86 assembled within the inner housing 32, as described above, the flow path for water entering the inlet 16 extends through the interior of the screen 56, through the slots 60, and following the arrows in FIG. 3, past the annular ring 54 (between ribs 52), and through the nozzle orifice(s) 98.

It is significant to note here that the above described arrangement isolates both the shaft 70, and substantially all of the brake assembly housing 66 from any direct contact with water under pressure within the sprinkler and prior to exiting the nozzle orifice(s) 98.

Upon commencement of flow of water under pressure into the sprinkler device via conduit 23 and fitting 22, the second inner housing 32 will be forced, against the action of spring 38, to an above ground, operative position as shown in FIG. 2. As the inner housing 32 moves upwardly, sealing edge 50 engages the outer surface thereof, insuring that no foreign matter enters the interior of the sprinkler. At the same time, water flowing in the above described flow path will be discharged through the nozzle orifice 98 and into engagement with distributor 100, causing the latter to rotate along with shaft 70.

By reason of shearing of the viscous fluid between drum 72 and the wall of the housing 66 which defines the chamber 73 during rotation of the shaft 70 and drum 72, effective braking of the rotor 100 is achieved. Specifically, it has been observed that an unbraked rotor will rotate, for a given water pressure, at about 1800 rpm. Under the same pressure conditions, the viscous brake of this invention will slow the rotor to a speed of between about ¼ rpm and about 12 rpm. By thus reducing the rotational speed of the rotor, maximum water throw is obtained, while minimizing the undesirable "horse tail" effects of the fluid stream under rotation.

When the water is "shut off", the inner housing will automatically return to its inoperative position within housing 12 by reason of the expansion of spring 38, and sealing edge 50 of the annular seal 48 will again prevent entry of dirt or debris into the interior of the device during retraction.

With reference now to FIGS. 6 and 7, an alternative exemplary embodiment of the invention is shown which incorporates a double telescopic configuration for the pop-up portion of the sprinkler. For ease of understanding, elements in FIGS. 6 and 7 in common with the embodiment illustrated in FIGS. 1 to 3, are designated by like reference numerals.

In this embodiment, an inner tubular housing 122 is provided which is similar to housing 32 but which is shorter in the axial direction, and terminates in an upper annular edge 124.

A second inner tubular housing 126 is telescopically mounted within an upper end of the first inner housing 122. The upper end of the second inner housing is internally threaded at 126 for receiving a nozzle disk 128 in the same manner as in the previously described embodiment. The second inner housing 126 is provided with a plurality of radially inwardly extending ribs 130 fixed to a support ring or collar 132. A rotor motor 64 is supported on the ring or collar 132 while the shaft 70 thereof rotatably mounts a distributor 100 as in the first described embodiment.

The second inner housing 126 is provided with a lower flange 136 forming a groove 138 which receives the lowermost coil of a second metal coil spring 140, of lesser diameter and lesser axial length than spring 38.

The uppermost coil of spring 140 is received in a second spring cap 142 which supports a second inverted U-seal 144. A radially inwardly directed flange 146 formed near the upper end of the first inner housing 122 provides an abutment surface for the spring cap 142. Thus, it will be appreciated that coil spring 140 urges the second inner housing 126 to a closed, inoperative position, with radially outermost edge 148 of the deflector 116 sitting atop the edge 124 of the first inner housing 122.

The forces necessary to compress the springs 38 and 140 are adjusted so that upon introducing water under pressure into this alternative construction, the first inner tubular housing 122 will be caused to extend out of the outer housing 12, as shown in phantom in FIG. 6, but the relative positions of the first and second inner housings 122, 126 initially remains the same.

Additional water pressure will then cause the second inner housing 126 to extend out of the first inner housing 122 as shown in FIG. 7, with spring 140 under compression between flange 136 and spring cap 142. This represents a fully extended and operative sprinkling position for this double pop-up embodiment. Shut off of the water supply will result in a two stage retraction in reverse of the extension movement described above. Otherwise, the construction and manner of operation of this embodiment is similar to that of the first described embodiment.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A pop-up, rotating stream sprinkler device comprising:

a first outer housing having a first longitudinal axis, and an inlet end adapted for connection to a source of liquid under pressure;

a second inner housing telescopically mounted within said first outer housing for movement between retracted and extended positions, and having a second longitudinal axis coincident with the first longitudinal axis, and an outlet end adapted to discharge to atmosphere a stream of said liquid under pressure;

a brake assembly including a brake assembly housing mounted in said second inner housing;

a shaft adjacent the outlet end of the second inner housing, one end of said shaft supporting a rotary distributor downstream of said outlet end, and the other end of said shaft rotatably mounted in said brake assembly housing upstream of said outlet end; and means for isolating said shaft and substantially all of said brake assembly housing from said liquid under pressure at all points upstream of said outlet end.

2. A pop-up, rotating stream sprinkler as defined in claim 1 and further including a spring located between said first and second housings, normally biasing said second housing to the retracted position within said first housing.

3. A pop-up, rotating stream sprinkler as defined in claim 1 and further including a nozzle disk having at least one discharge orifice formed therein, said disk removeably secured in said outlet end of said second housing.

4. A pop-up, rotating stream sprinkler as defined in claim 1 and wherein said brake assembly housing encloses a viscous brake capable of reducing rotational speed of said rotary distributor from an unbraked speed of at least about 1800 rpm to within a range of about ¼ rpm. to about 12 rpm.

5. A pop-up, rotating stream sprinkler as defined in claim 3 and wherein said brake assembly housing encloses a viscous brake capable of reducing rotational speed of said rotary distributor from an unbraked speed of at least about 1800 rpm to within a range of about ¼ rpm. to about 12 rpm.

6. A pop-up, rotating stream sprinkler as defined in claim 1 wherein seal means are provided in said brake assembly housing where the shaft enters the housing.

7. A pop-up, rotating stream sprinkler as defined in claim 6 and wherein said one end of said shaft is threaded to receive said rotary distributor, and wherein said threads extend to said seal means.

8. A pop-up, rotating stream sprinkler as defined in claim 1, wherein said rotary distributor is mounted for rotation about said axes, and is provided with a plurality of upwardly and outwardly extending grooves, each of which is slightly radially offset from said axes.

9. A pop-up, rotating stream sprinkler as defined in claim 8 wherein said rotary distributor is provided with an adjustable deflector cap for deflecting liquid issuing from said grooves.

10. A pop-up, rotating stream sprinkler as defined in claim 9 wherein said deflector cap is threadably received in a bore formed in said distributor.

11. A pop-up, rotating stream sprinkler as defined in claim 1 and further comprising an end cap removeably attached to an upper open end of the first outer housing, said end cap having an opening therein for accommodating movement of said second inner housing between said retracted and extended positions, said opening having a peripheral resilient seal mounted therein.

12. A pop-up rotating stream sprinkler device comprising:

a first outer housing having a substantially closed lower end and an open upper end, including an inlet in said closed lower end adapted for connection to a source of liquid under pressure;

a second inner housing telescopically mounted within said first outer housing having an outlet end adapted to discharge to atmosphere a stream of said liquid under pressure;

a distributor mounted on one end of a shaft for rotation therewith, said distributor located downstream of said outlet end;

a brake assembly including a brake assembly housing mounted in said second inner housing, the other end of said shaft rotatably mounted within said brake assembly housing; wherein said brake assembly housing is located upstream of said outlet end, and flow path means for the liquid under pressure which isolates said shaft from any contact with the liquid under pressure, prior to discharge from said outlet end, such that no high pressure shaft seals are required;

and wherein a cylindrical screen is mounted within said second inner housing, said screen having a solid recess formed within an upper portion thereof for enclosing at least a portion of said brake assembly housing.

13. A pop-up, rotating stream sprinkler as defined in claim 12 wherein said brake assembly housing is supported on a collar fixed within said second inner housing, said collar being in engagement with an uppermost surface of said screen, in substantial alignment with said recess, such that substantially all of said brake assembly housing is enclosed by said solid recess and said collar.

14. A pop-up, rotating stream sprinkler as defined in claim 12 and wherein a nozzle disk is removeably secured within the outlet end of said second inner housing, said nozzle disk formed with at least one discharge orifice, and wherein said nozzle disk engages a static seal provided in said brake assembly housing radially inwardly of said at least one discharge orifice.

15. A pop-up, rotating stream sprinkler as defined in claim 12 and wherein said flow path means directs fluid under pressure generally parallel to said shaft but radially outwardly of said solid recess, said brake assembly housing and said shaft.

16. A pop-up, rotating stream sprinkler as defined in claim 12 and further including a spring located between said first and second housings, normally biasing said second housing to a retracted inoperative position within said first housing, and wherein said second housing is adapted to extend out of said first outer housing to an extended operative position in response to liquid under pressure flowing into the sprinkler.

17. A pop-up, rotating stream sprinkler as defined in claim 12 and wherein said brake assembly housing encloses viscous brake means capable of reducing rotational speed of said distributor from an unbraked speed of at least about 1800 rpm to within a range of about ¼ rpm. to about 12 rpm.

18. A pop-up, rotating stream sprinkler as defined in claim 12 wherein said rotary distributor includes multiple grooves for altering the direction of flow of liquid from a substantially vertical path to a radially outwardly directed path, and wherein the rotary distributor is further provided with an adjustable deflector cap for impinging on liquid issuing from said grooves.

19. A pop-up, rotating stream sprinkler as defined in claim 18 wherein said deflector cap is threadably received in a bore formed in said rotary distributor.

20. A pop-up, rotating stream sprinkler as defined in claim 12 and further including a third inner housing mounted telescopically between said first outer housing and said second inner housing, said second and third housings adapted to extend together out of said first outer housing under liquid pressure and said second inner housing adapted to thereafter extend out of said third inner housing under additional liquid pressure.

21. A pop-up, rotating stream sprinkler comprising:

at least one tubular housing having a longitudinal axis, said housing having an inlet end and an outlet end, and a flow passage therebetween for conducting liquid under pressure from said inlet end to said outlet end;

a replaceable nozzle disk mounted in said outlet end, said nozzle disk formed with at least one discharge orifice for discharging a stream of said liquid to atmosphere;

a distributor rotatably mounted downstream of said nozzle disk having surface means thereon for receiving said stream and causing said distributor to rotate about said axis;

a viscous brake assembly supported by an annular ring mounted within said at least one tubular housing upstream of said outlet end, said viscous brake assembly operatively connected to said distributor for controlling the speed of rotation thereof;

a cylindrical screen mounted within said at least one tubular housing, said screen located within said flow passage and having an inlet end and an outlet end, the outlet end of said cylindrical screen engaging said annular ring and having a centrally arranged recess for receiving and enclosing at least a portion of said brake assembly.

22. A pop-up, rotating stream sprinkler as defined in claim 21 including a plurality of interchangeable nozzle disks, each disk having a successively arcuately enlarged discharge orifice such that said sprinkler is capable of sprinkling patterns extending from at least about 90° to a full 360°.

23. A pop-up, rotating stream sprinkler as defined in claim 21 and further including an outer tubular housing at least partially enclosing said at least one tubular housing.

24. A pop-up, rotating stream sprinkler as defined in claim 23 wherein said at least one tubular housing is spring biased to a normally retracted position within said outer tubular housing.

25. A pop-up, rotating stream sprinkler as defined in claim 24 wherein said outer tubular housing is provided with an end cap, said end cap having a central opening through which said at least one tubular housing at least partially extends in response to flow of liquid under pressure.

26. A rotating stream sprinkler comprising:

a sprinkler housing provided with an inlet end and an outlet end, said outlet end including discharge orifice means;

rotary distributor means mounted downstream of said discharge orifice means;

brake means including a brake housing mounted within said sprinkler housing and upstream of said discharge orifice means;

a rotatable shaft extending between said rotary distributor means and said brake housing; and flow path means for carrying liquid under pressure between said inlet end and said outlet end, said flow path means for isolating said shaft and substantially all of said brake housing from contact with liquid under pressure upstream of said discharge orifice means.

27. A rotating stream sprinkler as defined in claim 26 wherein said brake means comprises a chamber formed within said brake housing; a viscous fluid in said chamber; and a drum attached to said shaft and located within said chamber.

28. A pop-up, rotating stream sprinkler device comprising:

a first outer housing having a first longitudinal axis, and an inlet end adapted for connection to a source of liquid under pressure;

a second inner housing telescopically mounted within said first outer housing for movement between retracted and extended positions, and having a second longitudinal axis coincident with the first longitudinal axis, and an outlet end adapted to discharge to atmosphere a stream of said liquid under pressure;

a brake assembly including a brake assembly housing being mounted in said second inner housing;

a shaft adjacent the outlet end of the second inner housing, one end of said shaft supporting a rotary distributor downstream of said outlet end, and the other end of said shaft rotatably mounted in said brake assembly housing upstream of said outlet end; and wherein said shaft is isolated from said liquid under pressure at all points upstream of said outlet end;

wherein seal means are provided in said brake assembly housing where the shaft enters the housing; and wherein said one end of said shaft is provided with screw threads for mounting said rotary distributor, and wherein said threads extend to said seal means.

29. A pop-up, rotating stream sprinkler device comprising:

a first outer housing having a first longitudinal axis, and an inlet end adapted for connection to a source of liquid under pressure;

a second inner housing telescopically mounted within said first outer housing for movement between retracted and extended positions, and having a second longitudinal axis coincident with the first longitudinal axis, and an outlet end provided with a nozzle disk including an orifice adapted to discharge to atmosphere a stream of said liquid under pressure;

a brake assembly including a brake assembly housing mounted in said second inner housing;

a shaft adjacent the outlet end of the second inner housing, one end of said shaft supporting a rotary distributor downstream of said outlet end, and the other end of said shaft rotatably mounted in said brake assembly housing upstream of said outlet end, said brake assembly housing provided with a resilient seal element surrounding said shaft, and said nozzle disk having a depending skirt portion located radially inwardly of said orifice and in engagement with said resilient seal element so that said shaft is isolated from said liquid under pressure upstream of said outlet end.

* * * * *